US006989752B2

(12) United States Patent
Shugrue

(10) Patent No.: US 6,989,752 B2
(45) Date of Patent: Jan. 24, 2006

(54) METHODS AND APPARATUS FOR A SECURITY SYSTEM

(76) Inventor: John K. Shugrue, 1093 Nez Pierce, Fremont, CA (US) 94593-6935

( * ) Notice: Subject to any disclaimer, the term of this patent is extended or adjusted under 35 U.S.C. 154(b) by 154 days.

(21) Appl. No.: 10/191,762

(22) Filed: Jul. 8, 2002

(65) Prior Publication Data

US 2003/0038720 A1 Feb. 27, 2003

Related U.S. Application Data

(60) Provisional application No. 60/303,647, filed on Jul. 7, 2001.

(51) Int. Cl.
*G08B 23/00* (2006.01)

(52) U.S. Cl. ..... 340/573.1; 340/573.3; 340/573.4; 340/568.2; 340/539.1; 340/539.11; 340/539.15

(58) Field of Classification Search ..... 340/573.1, 340/573.4, 572.8, 571, 572.1, 572.5, 988, 340/573.3, 568.2, 539.1, 539.11, 539.15
See application file for complete search history.

(56) References Cited

U.S. PATENT DOCUMENTS

| | | | | |
|---|---|---|---|---|
| 4,899,135 | A | 2/1990 | Ghahariran | 340/573 |
| 5,612,675 | A | 3/1997 | Jennings et al. | 340/573 |
| 5,652,569 | A | 7/1997 | Gerstenberger et al. | 340/573 |
| 5,742,233 | A | 4/1998 | Hoffman et al. | 340/573 |
| 5,900,817 | A | 5/1999 | Olmassakian | 340/573.1 |
| 5,923,255 | A | 7/1999 | Vahadatshoar | 340/573.4 |
| 5,936,529 | A | 8/1999 | Reisman et al. | 340/573.1 |
| 5,936,530 | A | 8/1999 | Meinhold | 340/573.1 |
| 6,025,779 | A | 2/2000 | Huang | 340/539 |
| 6,028,519 | A | 2/2000 | Dessureau et al. | 340/573.1 |
| 6,281,800 | B1 | 8/2001 | Sizemore | 340/574 |

OTHER PUBLICATIONS

U.S. Appl. No. 60/303,647, Filed Jul. 7, 2001.

*Primary Examiner*—Julie Bichngoc Lieu
(74) *Attorney, Agent, or Firm*—Larry Williams

(57) ABSTRACT

Described are methods and apparatus for a security system. In one embodiment, the system includes capabilities to aid in locating an item that is being monitored when the item's location is unknown. The embodiment also includes capabilities for sounding an alarm when the item is believed to be missing.

18 Claims, 4 Drawing Sheets

METHODS AND APPARATUS FOR A SECURITY SYSTEM

CROSS-REFERENCE

The present application claims benefit of U.S. Provisional Patent Application No. 60/303,647, filed on Jul. 7, 2001. U.S. Provisional Patent Application No. 60/303,647 filed on Jul. 7, 2001 is incorporated herein, in its entirety, by this reference.

BACKGROUND

This invention relates to improved methods and apparatus for security systems for movable items.

There are numerous situations requiring reliable and efficient methods and apparatus for security systems such as those for monitoring children, the mentally handicapped, pets or other animals, and inanimate objects such as electronic devices like computers, and particularly laptop computers. In other words, security systems are needed for items that are movable or are otherwise portable so as to aid in preventing the loss of the items as a result of abductions and theft.

Regarding the problem of child security, every year there are tens of thousands of cases of missing children. A large fraction of those reported cases involve child abductions by either a family member or a stranger. Although the reasons for the abductions are varied as are the final outcome, child abduction is a situation that every parent wishes to avoid. Indeed, for the worst cases, it is not merely abduction; it is usually abduction and murder. This is a very serious and very unpleasant occurrence in society.

Various technologies have been developed for use in providing security for children or other items that are being monitored. Many of the standard technologies involve some type of alarm that is sounded when a child or other item being monitored is believed to be in danger of being abducted, lost, or stolen. However, the standard technologies have shortcomings that reduce their effectiveness in providing security. Some of the standard technologies are very complex and may be expensive to implement. Alternatively, some of the standard technologies are easily defeated by an abductor. Furthermore, some of the standard technologies are not highly suitable for handling false alarms. Lastly, some of the standard technologies are not very suitable for use with younger children such as children less than about 10 years old and still less suitable for children in the age range from about 1–5 years old.

There is a need for improved methods and apparatus for providing security for children as well as other items that are being monitored. Particularly, there is a need for methods and apparatus that overcome one or more of the deficiencies of the standard technologies for monitoring children as well as for monitoring other items.

SUMMARY

Embodiments of the present invention seek to provide methods and apparatus that can overcome one or more deficiencies in security systems for monitoring and protecting movable items. One aspect of the present invention includes methods and apparatus to facilitate determining whether an item is missing or not before sounding an alarm. A further aspect of the present invention is an apparatus with improved tamper resistant features to prevent defeating the security system. Still a further aspect of the present invention includes improvements to allow easier attachment, adjustment, and removal of the security device from the item being secured.

One embodiment of the present invention includes a security system for a movable item comprising a transmitter and a receiver. The receiver is capable of traveling with the item. The transmitter is capable of transmitting a first signal to the receiver and the transmitter is capable of transmitting a second signal to the receiver. The receiver is capable of receiving the first signal from the transmitter and emitting a first audible sound in response to the first signal. The receiver is also capable of receiving the second signal from the transmitter and emitting a second audible sound in response to the second signal.

In a further embodiment, the receiver is capable of producing the first audible sound so that the first audible sound can be heard over a short distance and the receiver is capable of producing the second audible sound so that the second audible sound can be heard over a long distance.

A still further embodiment of the present invention may include a circuit capable of turning on the second audible sound in response to at least one of unauthorized detaching of the receiver from the item, unauthorized de-activation of at least one function of the receiver, and unauthorized modification of at least one function of the receiver.

Another aspect of the present invention includes a system for use by a supervisor or guardian to provide security for a child. In one embodiment, the system includes a transmitter capable of transmitting at least one of a first signal and a second signal. The transmitter is arranged so that it can be operated by the supervisor. The system also includes a receiver capable of receiving signals from the transmitter and capable of responding to the signals by emitting a first audible sound in response to the first signal or a second audible sound in response to the second signal. A belt may be connected to the receiver for attaching the receiver to the child. The belt may include an electric circuit coupled to the receiver so that the circuit is capable of turning on the second audible sound in response to at least one of: unauthorized detaching of the receiver from the child, cutting through the belt to remove the belt from the child, unauthorized de-activation of at least one function of the receiver, and unauthorized modification of at least one function of the receiver.

In one configuration of the present invention, the receiver is capable of producing the first audible sound so that the first audible sound can be heard over a short distance for locating the child when the child is near the supervisor but possibly out of sight of the supervisor. Furthermore, the receiver may be capable of producing the second audible sound so that the second audible sound can be heard over a long distance for at least one of: locating the child, indicating that the child is in danger, and indicating that the supervisor is aware that the child is in danger.

It is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out aspects of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is the abstract intended, in any way, to be limiting as to the scope of the invention.

The above and still further features and advantages of the present invention will become apparent upon consideration of the following detailed descriptions of specific embodiments thereof, especially when taken in conjunction with the accompanying drawings.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DESCRIPTION

The following detailed description is primarily related to applications involving a security system for children, specifically, locating and monitoring children so as to prevent or hinder abductions of children. However, it is to be understood that embodiments of the present invention have applications beyond those of security systems for children. Other applications include security systems for the mentally handicapped, pets or other animals, and inanimate objects such as electronic devices like computers, and particularly laptop computers.

Figure 1:
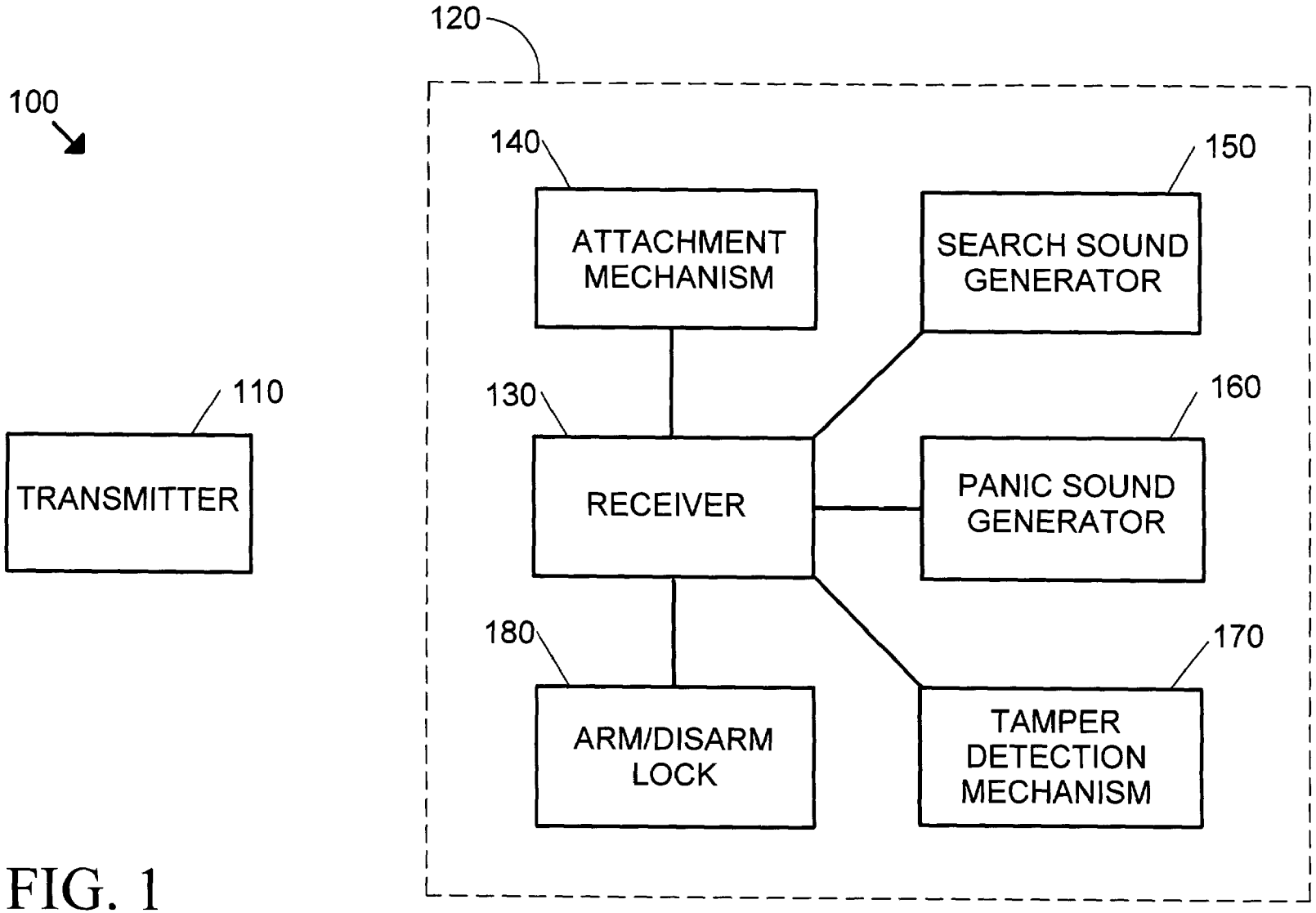
FIG. 1 is a block diagram of an embodiment of the present invention.

Reference is now made to FIG. 1 where there is shown a block diagram of a security system 100 according to an embodiment of the present invention. System 100 includes a transmitter 110 and a receiving unit 120. Transmitter 110 is capable of wirelessly transmitting at least two signals using frequencies in the electromagnetic spectrum. Receiving unit 120 is capable of detecting and responding to the signals from transmitter 110. There are numerous commercially available transmitters that can be used in embodiments of transmitter 110. Similarly, there are numerous commercially available receivers they can be used in embodiments of receiver unit 120.

For preferred embodiments of the present invention, receiver unit 120 includes a receiver 130, an attachment mechanism 140, a search sound generator 150, a panic sound generator 160, a tamper detection mechanism 170, and an arm/disarm lock. Preferably, receiver 130 includes a housing for substantially containing the electronic components of receiver 130. In a preferred embodiment, the housing for receiver 130 is made of a tough material that is capable of substantially protecting the contents of the housing from physical damage. Some examples of suitable materials for the housing of receiver 130 are aluminum, aluminum alloys, steel, stainless steel, titanium, engineering plastics such as polycarbonate, and composite materials such as fiber-matrix composites.

In a preferred embodiment, the housing for receiver 130 includes a compartment for containing a power source such as a compartment for containing batteries for providing electrical power for receiver 130. Although a variety of designs can be used for the housing for receiver 130, preferred designs for the housing include those that do not allow easy access to the interior of the housing when receiving unit 120 is in use so that the housing can aid in preventing unauthorized tampering with items within the housing such as the electronic components for receiver 130, tamper detection mechanism 170, sound generator 150, sound generator 160 and the power supply.

Attachment mechanism 140 is coupled to receiver 130 and is capable of attaching receiver 130 to the item being monitored. Preferably, attachment mechanism 140 is physically connected with the housing of receiver 130. The attachment mechanism 140 may be selected from numerous possible attachment mechanisms such as a belt, a strap, a chain, an adhesive, a cable, and others. More specifically, for child monitoring applications, attachment mechanism 140 serves to attach receiver 130 to the child being monitored. Examples of attachment mechanisms that may be used for attachment mechanism 140 for child monitoring applications include a belt, a shoulder harness, a wrist bracelet, an ankle bracelet, a wrist trap, and an ankle strap. In a preferred embodiment, attachment mechanism 140 includes a belt for attachment around the child's waist. In other embodiments, attachment mechanism 140 may comprise a metal cable such as a multiple strand metal cable that is substantially impossible to sever with a knife.

Search sound generator 150 is coupled to receiver 130 so that receiver 130 can activate sound generator 150 so that generator 150 produces a first sound in response to a first signal received by receiver 130 from transmitter 110. In one embodiment, receiver 130 is coupled to search sound generator 150 so that receiver 130 controls the application of electric power to search sound generator 150 so that sound generator 150 produces the first sound when power is applied and is silent when power to search sound generator 150 is terminated. In a preferred embodiment of the present invention, the electric power for search sound generator 150 is provided by the power source used by receiver 130.

In addition, the search sound generator 160 is coupled to receiver 130 so that receiver 130 can activate panic sound generator 160 so that panic sound generator 160 produces a second sound in response to a second signal received by receiver 130 from transmitter 110. In one embodiment, receiver 130 is coupled to panic sound generator 160 so that receiver 130 controls the application of electric power to search sound generator 160 so that panic sound generator 160 produces the second sound when power is applied and is silent when power to panic sound generator 160 is terminated. In one embodiment of the present invention, the electric power for search sound generator 160 is provided by the power source used by receiver 130.

Furthermore, in a preferred embodiment of the present invention, search sound generator 150 and panic sound generator 160 are attached to the housing of receiver 130. More preferably, search sound generator 150 and panic sound generator 160 are attached to an inside wall of the housing of receiver 130, and the housing has one or more holes to allow sound produced by search sound generator 150 or panic sound generator 160 to more easily propagate to the exterior of the housing.

Search sound generator 150 is capable of producing the first sound and panic sound generator 160 is capable of producing the second sound so that the first sound and the second sound are dissimilar. Preferably, the first sound and the second sound are dissimilar in terms of sound intensity. More specifically, the first sound is preferably of a lower intensity than the second sound so that a human can hear the second sound over a longer distance than the first sound can be heard. Optionally, the first sound and the second sound may be dissimilar in terms of other sound characteristics such as the frequency of the sound waves and such as the type of sound. In a preferred embodiment, the first sound is that of a buzzer and the second sound is that of a siren.

Tamper detection mechanism 170 serves to substantially prevent unauthorized tampering activities directed toward deactivating or neutralizing the function of receiving unit 120 or unauthorized removal of receiving unit 120 from the child or other item that is being monitored. The tamper detection mechanism 170 may include one or more capabilities for detecting the tampering activity. One optional capability of mechanism 170 includes an electrical circuit coupled to the power supply that provides power to panic sound generator 160. The electrical circuit is coupled to the power supply so that if the circuit is opened such as by disconnecting attachment mechanism 140 from the child or other object that is being monitored, then panic sound generator 160 is activated to generate the second sound.

Arm/disarm lock 180 is coupled to receiver 130 and particularly the power supply for receiver 130, search sound generator 150, and panic sound generator 160. Specifically, lock 180 includes a lockable switch for turning the power on and turning the power off to allow operation or non-operation of receiver unit 120. In other words, lock 180 is a manual switch for controlling the power availability for at least one of receiver 130, search sound generator 150, and panic sound generator 160.

Preferred embodiments of the present invention are configured so that lock 180 controls power availability for all of the power consuming components of receiving unit 120.

Figure 2:
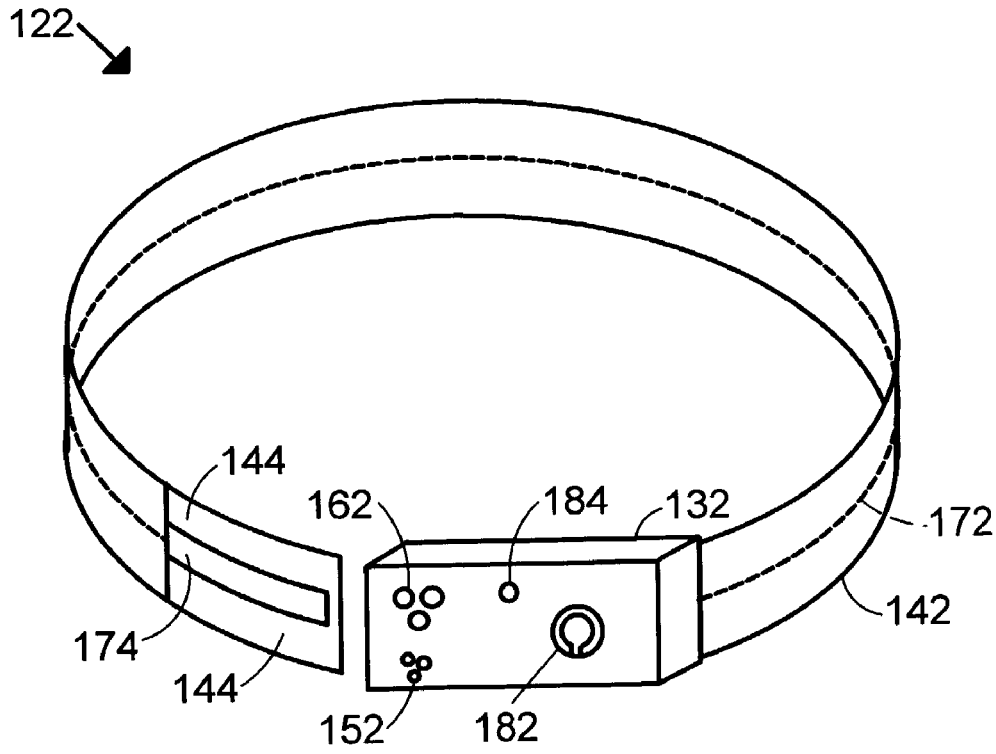
FIG. 2 is a diagram of an embodiment of the present invention.

Reference is now made to FIG. 2 where there is shown a more detailed view of an embodiment of a receiving unit 122 according to the teaching of the present invention. FIG. 2 shows a perspective view of receiving unit 122. Receiving unit 122 includes a housing 132 for a receiver substantially the same as that described for the embodiment shown in FIG. 1 (receiver not shown in FIG. 2). Housing 132 is substantially the same as that described for the embodiment shown in FIG. 1. Preferably, the receiver comprises a printed circuit board with appropriate electronic components and circuits for operating as a receiver and the printed circuit court is held in housing 132.

Also shown in FIG. 2 is a belt 142 for attaching the receiver to a child or other item that is being monitored. Preferably, one end of belt 142 is physically connected with housing 132. In a still more preferred embodiment, belt 142 comprises a web structure of a high-strength material such as nylon and such as Kevlar(R). For child monitoring applications, it is preferable for belt 132 to be of a length suitable for attachment around the child's waist.

A variety of known techniques may be used for connecting the ends of belt 142. A preferred embodiment of the present invention includes hook and loop structures such as Velcro® for connecting the ends of belt 142. FIG. 2 shows one end of belt 142 having a hook structure 144 which attaches to a corresponding loop structure connected with the rear side of housing 132 (the corresponding loop structure not shown in FIG. 2. Optionally, the embodiments of the present invention may have the hook structure and loop structure locations reversed. In a preferred embodiment of the present invention, hook structure 144 or the corresponding loop structure is an elongated section of material with the long dimension substantially aligned with the length of the belt so that the diameter of the belt, when fastened, can be adjusted to provide a snug fit around the child or other item being monitored.

FIG. 2 also shows the location of a search sound generator 152. Search sound generator 152 is located substantially within housing 132. Preferably, housing 132 has a hole or a plurality of holes adjacent to search sound generator 152 to facilitate the propagation of sound from search sound generator 152.

In addition, FIG. 2 shows the location of panic sound generator 162. The panic sound generator 162 is located substantially within housing 132. Preferably, housing 132 has a hole or a plurality of holes adjacent to panic sound generator 162 to facilitate the propagation of sound from panic sound generator 162.

Receiving unit 120 shown in FIG. 2 includes an on/off switch 182. Switch 182 includes a lock that requires a key for switching the operation of receiving unit 122 on or off. Specifically, switch 182 makes power available or unavailable to at least one of the receiver, search sound generator 152, and panic sound generator 162. The configuration requiring a key for on/off control is included so as to substantially prevent unauthorized shutoff or unauthorized activation of receiving unit 122. In other words, the lock and key configuration is a characteristic of the embodiment of the present invention shown in FIG. 2 for preventing unauthorized tampering with the operation of receiving unit 122.

The embodiment shown in FIG. 2 also includes a tamper detection mechanism that comprises an electrical interlock circuit integrated with belt 142 and coupled to at least one of the receiver in housing 132, the power supply for panic sound generator 162, and panic sound generator 162. The interlock circuit includes an electrically conducting wire 172 substantially contacting belt 142 through the length of belt 142. Preferably, wire 172 is threaded through the interior of belt 142 through at least a portion of the length of belt 142. FIG. 2 shows wire 172 as a dashed line to indicate that wire 172 is located in the interior of belt 142. For embodiments of belt 142 that comprise a web material such as nylon webbing, it is preferable to arrange wire 172 so that wire 172 is interweaved through the webbing of belt 142. Optionally, materials other than nylon may be used for belt 142. In one embodiment of the present invention, wire 172 comprises a 30 AWG wire.

Preferably, the interlock circuit also includes an electrode 174 that is connected with one end of wire 172. FIG. 2 shows electrode 174 on the surface of one end of belt 142. In one embodiment of the present invention, electrode 174 is a substantially flexible electrical conductor. A second electrode (not shown in FIG. 2) is also included for making contact with electrode 174. The second electrode is connected with the rear of housing 132 and is arranged so as to be capable of electrically contacting electrode 174 and thus electrically closing the interlock circuit of the tamper detection mechanism. Wire 172, electrode 174, and the second electrode are included in the interlock circuit so that when receiving unit 122 is armed, the panic sound generator is activated if the interlock circuit is broken by at least one of severing wire 172 and breaking the electrical contact between electrode 174 and the second electrode. This means that cutting through the belt will trigger the alarm or disconnecting the belt will trigger the alarm.

For the embodiment shown in FIG. 2, electrode 174 and the second electrode are arranged so that by fastening belt 142 by contacting hook material 144 with the corresponding loop material on the back of housing 132 causes electrode 174 and the second electrode to make electrical contact for completing the interlock circuit. This means that detaching hook material 144 from the corresponding loop material will cause activation of the panic sound generator when receiving unit 122 is armed. It also means that receiving unit 122 must be turned OFF prior to being removed from the child or other item being monitored. Including the arm/disarm control switch will also help prevent accidentally leaving receiving unit 122 ON and prevent unintentionally draining the battery.

In a preferred embodiment, electrode 174 is an elongated substantially flexible electrical conductor having a width of about ½ inch (1.2 mm) secured to the middle of a band of Velcro® or other types of hook and loop structures for fastening and unfastening. In addition, the second electrode is preferably a 14 AWG elongated electrical conductor attached to the rear side of housing 142 adjacent to a corresponding band of Velcro® or other types of hook and loop structures for fastening belt 142.

The length of electrode 174 and the length of the second electrode may be selected based on the desired amount of adjustment capability for belt 142 around the child or other item being monitored. A close-fitting attachment of receiving unit 122 to the child or other item being monitored is preferable so as to hinder having receiving unit 122 removed from the child or other item being monitored without triggering the tamper detection mechanism. In other words, it is preferable for receiving unit 122 to have a sufficiently snug fit so as to prevent an abductor from removing receiving unit 120 from the child or other item being monitored. In a preferred embodiment, electrode 174 has a length of about 3 inches (7.5 cm) and the second electrode has a length of about 3 inches (7.5 cm). It is to be understood that the length selection is an option and it is not necessary for the length of electrode 174 to equal the length of the second electrode.

Embodiments of the present invention that use a hook and loop closure mechanism such as Velcro®, preferably have at least one of the length of the materials of hook structure and the length of the materials of loop structure elongated so as to allow the diameter of the belt to be adjustable to provide a snug fit for the belt around the child or other item being monitored.

It is to be understood that other attachments methods may be used in embodiments of the present invention. Alternative embodiments may include a harness for attachment around the shoulders of the person being monitored. Or the embodiment may include a metal cable for attachment around the waist of a person or child being monitored. The cable may be fastened with a lock such as a cable lock like that used on some bicycle locks. An interlock circuit for tamper detection may also be used with other types of fastening mechanisms.

In a preferred embodiment, receiving unit 122 includes an indicator for showing information about the status of receiving unit 122. For example, receiving unit 122 shown in FIG. 2 includes a light emitting diode 184 for indicating when receiving unit 122 is armed or disarm. In this embodiment, diode 184 is on when receiving unit 122 is armed and diode 184 is off when receiving unit 122 is disarmed. Receiving unit 122 may also be configured to indicate other information using diode 184. In a preferred embodiment, diode 184 is configured to provide either a bright light or a dim light to indicate the status of the battery used for powering receiving unit 122. In one configuration, the dim light may be used to indicate that receiving unit 122 is on, and the bright light may be used to indicate that the power available from the batteries is low. In other words, the bright light would be an indicator that the battery should be replaced or recharged. Of course, it is to be understood that additional status indicators can be used and other types of status indicators can be used; embodiments of the present invention are not limited to the use of light emitting diodes as indicators.

Figure 3:
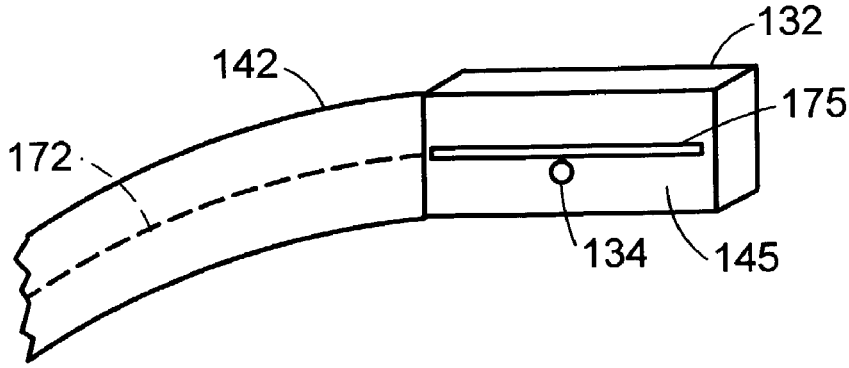
FIG. 3 is a diagram of an embodiment of the present invention.

Reference is now made to FIG. 3 where there is shown a perspective view of a portion of the receiving unit described in FIG. 2. Specifically, FIG. 3 shows a view of the rear of housing 132 and a portion of belt 142. FIG. 3 also shows wire 172, second electrode 175 attached to the rear side of housing 132, and loop structure 145 for attachment to the corresponding hook structure 144 described for FIG. 2 (hook structure 144 not shown in FIG. 3). The loop structure 145 is attached to the rear side of housing 132. FIG. 3 also shows an optional screw 134 for access to a battery compartment in housing 132. As an option for some embodiments of the present invention, screw 134 may be used for attaching a cover for the battery compartment of housing 142. Of course, the screw may also be used for gaining access to the interior of housing 142 for activities such as adjustment and maintenance of the receiver and tamper detection mechanism contained in housing 132.

Figure 4:
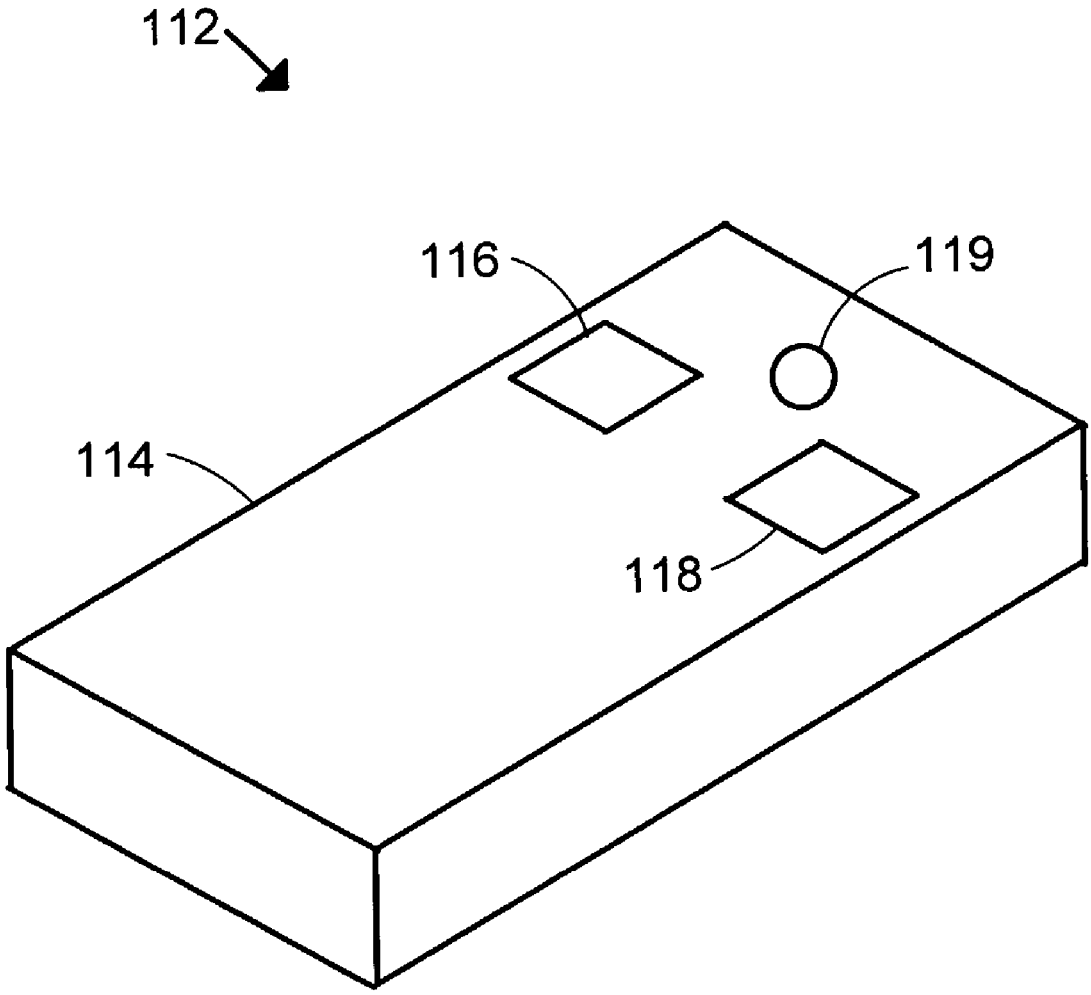
FIG. 4 is a diagram of an embodiment of the present invention.

Reference is now made to FIG. 4 where there is shown a perspective view of a transmitter 112 according to one embodiment of the present invention. Transmitter 112 is capable of wirelessly transmitting signals to a receiving unit such as the receiving unit described in FIG. 1, FIG. 2, and FIG. 3 (receiving unit not shown in FIG. 4). Transmitter 112 includes a housing 114 for substantially enclosing the electronic components of the transmitter. Preferably, housing 114 is substantially rigid and may be made from materials such as metal, metal alloys, and plastic.

Transmitter 112 has a search button 116 for activating a search sound generator.

More specifically, the search button is used to activate the search sound which may be a sound such as that of a 400 Hz buzzer and may have a sound intensity of about 70 db. In a preferred embodiment, the search signal is generated as long as button 116 is pressed. The search sound is, preferably, selected so as to be very directional so that it is easy to determine the location of the child or other object being monitored. In one embodiment of the present invention, the approximate arrange for the search sound may be about 100 feet (about 30 m).

The transmitter 112 also includes a panic button 118 for activating a panic sound generator. In a preferred embodiment, the panic sound generator is capable of producing a sound having an intensity of about 120 db such as a sound produced by a loud siren. Preferably, panic button 118 initiates a latched signal that will remain on until the panic sound generator is turned off. In one embodiment, the panic sound generator is also connected with search button 116 so that the panic sound generator is turned off after search button 116 is depressed. Alternatively, the panic sound generator may be connected to the arm/disarm switch so that panic sound generator is activated only after disarming receiving unit 122.

Preferably, transmitter 112 is configured so that it becomes active when either search button 116 or panic button 118 is pressed. In one embodiment, transmitter 112 is capable of wirelessly transmitting signals in the range 300 MHz to 375 MHz for a distance up to about 150 feet (45 m). Optionally, transmitter 112 may include a trim capacitor for tuning to the receiver frequency of receiving unit 122. The frequency may be set, for example, at approximately 318 MHz or any other frequency in the range of the transmitter that can be detected by the receiver. In one embodiment, transmitter 112 is capable transmitting signals using carrier waves having frequencies in the range of about 300 MHz to 440 MHz and all subranges subsumed therein.

It is to be understood that other embodiments of the present invention may use frequencies other than those in the range of about 300 MHz to 440 MHz. Furthermore, embodiments of the present invention may a larger operation distance than that for the embodiment given above. As another embodiment, a frequency of about 900 MHz may be used and the operating distance for transmitting signals to the receiver may be about 1000 feet.

Optionally, transmitter 112 may also include a status indicator such as a light emitting diode 119 shown in FIG. 4. The status indicator may be used for providing information such as the active or inactive state of transmitter 112. For instance, the indicator may be used to indicate that the search button 116 or panic button 118 has been or is being pressed.

In one embodiment, transmitter 112 includes a 10-position DIP switch capable of providing 1024 different possible codes. These signals feed to an encoder which will output a series signal of the DIP switch settings, along with the appropriate code for activating the search sound generator by depressing search button 116 or for activating the panic sound generator by depressing panic button 118. The signal is then sent into an LC oscillator set to the transmission frequency. A radio frequency transistor and loop antenna included in transmitter 112 then radiate the encoded signal on a carrier wave such as a 318 MHz carrier wave.

In a preferred embodiment, receiver unit 122 uses a MIC001 receiver integrated circuit which is a commercially available circuit that includes a complete superheterodyne receiver intended for use in the UHF frequency bands from 300 MHz to 440 MHz. Alternatively, embodiments of the present invention may use integrated circuits that are substantially equivalent to the MIC001 integrated circuit. The integrated circuit incorporates complete UHF down conversion and data demodulation functions. Once the carrier signal has been stripped, the signal is feed to the decoder circuit which may include a 10-position DIP switch and decoder circuit. The decoder compares the incoming signal to the DIP-switch setting on the receiver. If the signal matches the DIP-switch settings, the appropriate output line will activate the panic sound generator or the search sound generator, depending on whether the search button or the panic button was depressed.

Figure 5:
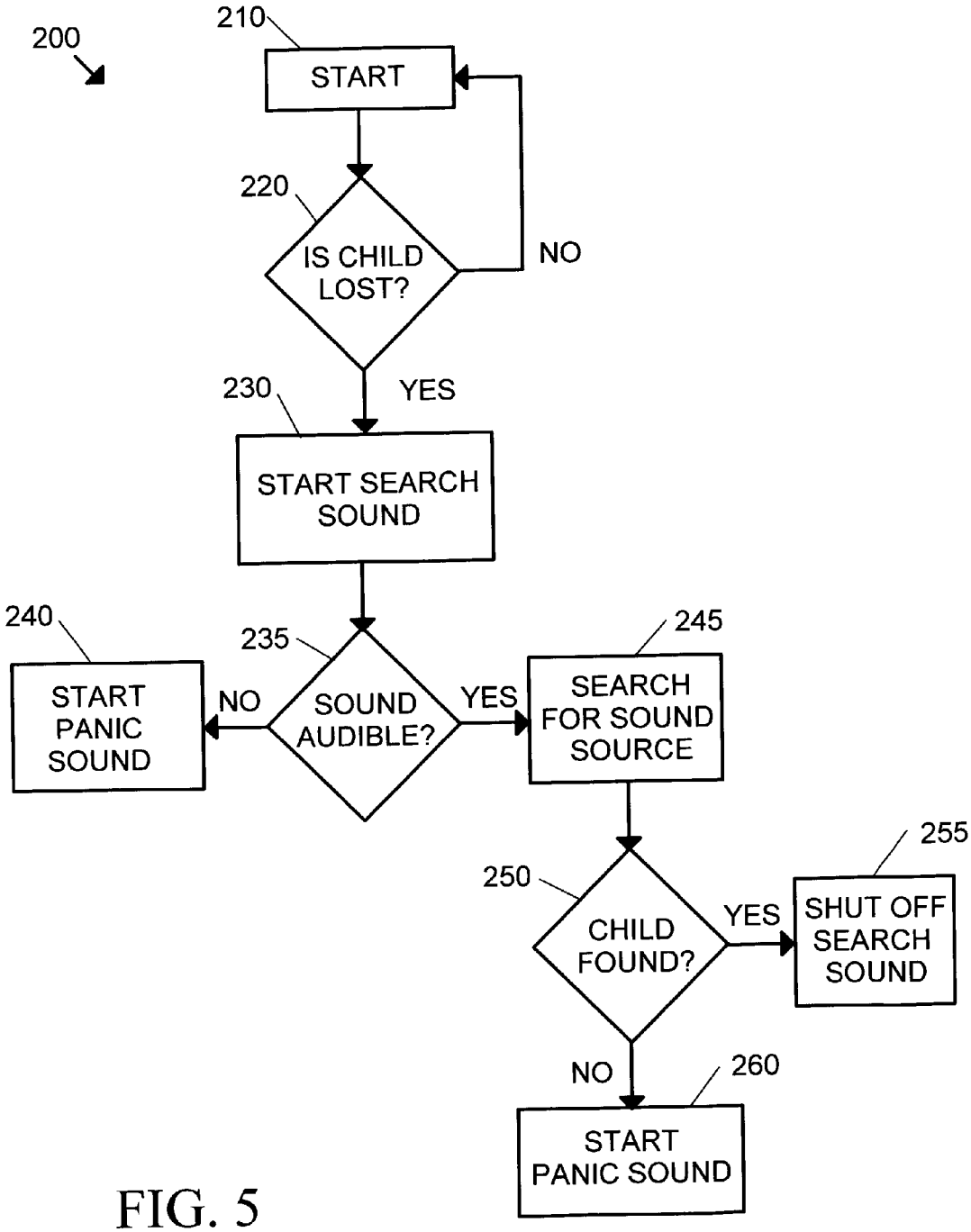
FIG. 5 is a diagram of an embodiment of the present invention.

Reference is now made to FIG. 5 where there is shown a flow diagram for a method 200 for use by a guardian for monitoring a child according to an embodiment of the present invention. The method is carried out by a guardian using embodiments of the present invention. Step 210 is the first step in the method and represents the start of the method. Step 220 follows step 210 and involves making the decision as to whether the child is lost or not lost. If the child is not lost, then return to step 210.

If the child is lost then the next step is step 230; step 230 includes activating a search sound for use in locating the child. Step 235 follows step 230. The step 235 is a decision step where the guardian determines whether the search sound is audible. If the search sound is not audible to the guardian then the next step after step 235 is step 240 which includes activating the panic sound. If the search sound is audible to the guardian then the next step after step 235 is step 245 which involves searching for the source of the search sound. Step 250 follows step 245. The step 250 is a decision step; if the child is found then the next step is step 255 which involves shutting off the search sound; if the child is not found, then the next step is step 260 which involves activating the panic sound.

Clearly, embodiments of the present invention can be used in numerous situations in which security is required. One example of a specific application for embodiments of the present invention includes providing security for children. Indeed, embodiments of the present invention can be used to quickly locate a small child or other item being monitored when missing from a supervisor or guardian in environments such as that of a store, a mall, and a home. Embodiments of the present invention are particularly suited for reducing the instances of sounding false alarms because of the capability of providing searching assistance for the guardian in the event the child is merely out of view and not in danger. The search assistance capability of embodiments of the present invention can help the guardian locate the child substantially without alarming other people who may be in the vicinity. This is also advantageous in that the guardian can search for the child substantially without scaring or alarming the child. This means that if the child is found using the search sound capabilities, then there is no need to disturb others in the area and no need to frighten the child.

In addition, embodiments of the present invention can be produced that are very simple to operate and do not require complex equipment for implementation. Furthermore, embodiments of the present invention offer flexibility in attaching the monitoring device to the child or other item being monitored. In other words, embodiments of the present invention are adjustable so as to more easily accommodate size variations for the child or other item being monitored.

Indeed, embodiments of the present invention can be easily put on a small child such as a child less than about 10 years old and can be used on still smaller children such as children in the age range of 1–5 years old. The belt of a receiving unit according to embodiments of the present invention can be attached around the child's waist using a fastening system such as Velcro®. In addition, the interlock system in some embodiments of the present invention makes it extremely difficult to remove the receiving unit from the child without alarming the guardian. Still further, for applications involving very small children, the fastening mechanism and embodiments of the present invention make it very difficult for the child to remove the receiving unit.

It is to be understood that although embodiments of the present invention are particularly suitable for use with children, embodiments of the present invention can also be used to monitor older children and adults; in other words, a person of any age can be monitored with embodiments of the present invention. Indeed, embodiments of the present invention are suitable for use in monitoring and providing security for mentally handicapped individuals or individuals that suffer from illnesses such as Alzheimer's disease.

While there have been described and illustrated specific embodiments of the invention, it will be clear that variations in the details of the embodiments specifically illustrated and described may be made without departing from the true spirit and scope of the invention as defined in the appended claims and their legal equivalents.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," "includes," "including," "has," "having," "at least one of," or any other variation thereof, are intended to cover a non-exclusive inclusion. For example, a process, method, article, or apparatus that comprises a list of elements is not necessarily limited only to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A security system for a movable item comprising: a transmitter and a receiving unit, the receiving unit being capable of being attached to the item, the transmitter being capable of transmitting a first signal and the transmitter being capable of transmitting a second signal, the receiving unit being responsive to the first signal from the transmitter and capable of emitting a first audible sound in response to the first signal so as to assist in determining the location of the item, the receiving unit being responsive to the second signal from the transmitter and being capable of emitting a second audible sound so as to indicate that the item is lost, stolen, or abducted, in response to the second signal, and wherein the first audible sound and the second audible sound are dissimilar, and wherein the transmitter transmits using a radio frequency carrier signal having a frequency in the range from about 300 MHz to about 440 MHz and all sub ranges subsumed therein.

2. The security system of claim 1 wherein the transmitter has a signal transmission range of up to about 150 ft.

3. A security system for a movable item comprising: a transmitter and a receiving unit, the receiving unit being capable of being attached to the item, the transmitter being capable of transmitting a first signal and the transmitter being capable of transmitting a second signal, the receiving unit being responsive to the first signal from the transmitter and capable of emitting a first audible sound in response to the first signal so as to assist in determining the location of the item, the receiving unit being responsive to the second signal from the transmitter and being capable of emitting a second audible sound so as to indicate that the item is lost, stolen, or abducted, in response to the second signal, and wherein the first audible sound and the second audible sound are dissimilar, and wherein the receiving unit is attached to the item so as to form an electrical circuit capable of activating the second audible sound in response to at least one of:

a) unauthorized detaching of the receiver from the item,
b) unauthorized de-activation of at least one function of the receiver, and
c) unauthorized modification of at least one function of the receiver.

4. A system for use by a supervisor to provide security for a child:

a transmitter capable of wirelessly transmitting at least one of a first signal and a second signal, the transmitter being arranged to be operated by the supervisor;
a first sound generator;
a second sound generator;
a receiver capable of receiving signals from the transmitter, the receiver being connected with the first sound generator so as to control activation of the first sound generator, the receiver being connected with the second sound generator so as to control activation of the second sound generator, the receiver being responsive to the signals by activating the first sound generator in response to the first signal or by activating the second sound generator in response to the second signal;
a belt connected with the receiver for attaching the receiver to the child, the belt comprising an electrical circuit coupled to the second sound generator and to the receiver, the circuit being capable of activating the second sound generator in response to at least one of:
a) unauthorized detaching of the receiver from the child,
b) culling through the belt to remove the belt from the child,
c) unauthorized de-activation of at least one function of the receiver, and
d) unauthorized modification of at least one function of the receiver.

5. The security system of claim 4 wherein the first sound generator is capable of producing a first audible sound so that the first audible sound can be heard over a short distance for locating the child, and the second sound generator is capable of producing a second audible sound so that the second audible sound can be heard over a long distance for at least one of:

a) locating the child,
b) indicating that the child is in danger, and
c) indicating that the supervisor is aware that the child is in danger.

6. The security system of claim 4 wherein the first sound generator is capable of producing the first audible sound at an intensity less than or equal to about 70 db and the second sound generator is capable of producing the second audible sound at an intensity greater than 70 db.

7. The security system of claim 4 wherein the second sound generator is capable of producing the second audible sound at an intensity of about 120 db.

8. The security system of claim 4 wherein the belt includes at least one of hook structures and loop structures for fastening and unfastening the belt.

9. The security system of claim 8 further comprising at least one electrical contact adjacent to or embedded in the at least one of hook structures and loop structures so as to close the electrical circuit when the belt is fastened and to open the electrical circuit when the belt is unfastened.

10. The security system of claim 9 wherein the electrical contact is sufficiently long so as to allow the diameter of the belt to be adjusted to snugly fit about the child and maintain the capability of closing the electrical circuit.

11. A method of providing security for an item, the method being performed using a transmitter and a receiving unit, the receiving unit being capable of producing a first audible sound in response to a first signal from the transmitter to assist in determining the location of the item and being capable of producing a second audible sound in response to a second signal from the transmitter to indicate that the item is lost, stolen, or abducted, the method being performed with the receiving unit attached to the item, the method comprising the steps of:

a) a) determining if the item location is known;

b) b) activating a search sound from the receiving unit to assist in determining the location of the item if the item location is not known;

c) c) activating a panic sound from the receiving unit if the item location was not determined in step b; and wherein step b includes using the transmitter to wirelessly transmit the first signal as a signal encoded on a radio frequency carrier wave having a frequency in the range of from about 300 MHz to about 440 MHz and all sub ranges subsumed therein and step c includes using the transmitter to wirelessly transmit the second signal as a signal encoded on a radio frequency carrier wave having a frequency in the range of from about 300 MHz to about 440 MHz and all sub ranges subsumed therein.

12. The method of claim 11 wherein the item is selected from the group consisting of a child, a mentally handicapped person, a pet, and a computer.

13. The method of claim 11 wherein the item is a child.

14. The method of claim 13 wherein the child is not greater than about 10 years old.

15. The security system of claim 3 wherein the receiving unit is capable of producing the first audible sound so that the first audible sound can be heard over a short distance and the receiver is capable of producing the second audible sound so that the second audible sound can be heard over a long distance.

16. The security system of claim 3 wherein the receiving unit is capable of producing the first audible sound at an intensity less than or equal to about 70 db and the receiving unit is capable of producing the second audible sound at an intensity greater than 70 db.

17. The security system of claim 3 wherein the receiving unit is capable of producing the second audible sound at an intensity of about 120 db.

18. The security system of claim 3 wherein the first audible sound has a frequency of about 400 Hz and an intensity of about 70 db.

* * * * *

UNITED STATES PATENT AND TRADEMARK OFFICE

CERTIFICATE OF CORRECTION

PATENT NO. : 6,989,752 B2
APPLICATION NO. : 10/191762
DATED : January 24, 2006
INVENTOR(S) : John K. Shugrue It is certified that error appears in the above-identified patent and that said Letters Patent is hereby corrected as shown below:

In the claims, column 12, line 33, delete "culling" and insert therefor -- cutting --.

Signed and Sealed this

Sixth Day of May, 2008

JON W. DUDAS
*Director of the United States Patent and Trademark Office*